US012532951B2

(12) United States Patent
Samain

(10) Patent No.: US 12,532,951 B2
(45) Date of Patent: Jan. 27, 2026

(54) APPLICATOR FOR APPLYING A HAIRCARE PRODUCT, AND ASSOCIATED APPLICATION METHOD

(71) Applicant: L'OREAL, Paris (FR)

(72) Inventor: Henri Samain, Chevilly-Larue (FR)

(73) Assignee: L'Oreal, Paris (FR)

( * ) Notice: Subject to any disclaimer, the term of this patent is extended or adjusted under 35 U.S.C. 154(b) by 564 days.

(21) Appl. No.: 17/610,630

(22) PCT Filed: May 22, 2020

(86) PCT No.: PCT/EP2020/064329
§ 371 (c)(1),
(2) Date: Nov. 11, 2021

(87) PCT Pub. No.: WO2020/234469
PCT Pub. Date: Nov. 26, 2020

(65) Prior Publication Data

US 2022/0312927 A1 Oct. 6, 2022

(30) Foreign Application Priority Data

May 23, 2019 (FR) ..... 11905430

(51) Int. Cl.
*A45D 24/00* (2006.01)
*A45D 19/02* (2006.01)
(Continued)

(52) U.S. Cl.
CPC ..... *A45D 19/026* (2021.01); *A45D 24/007* (2013.01); *A45D 24/22* (2013.01);
(Continued)

(58) Field of Classification Search
CPC ..... A45D 19/026; A45D 24/22; A45D 24/00; A45D 2007/0004; A45D 24/007; A46B 9/023; A46B 15/0004
See application file for complete search history.

(56) References Cited

U.S. PATENT DOCUMENTS 2,456,138 A * 12/1948 Marini ..... A45D 8/12 132/138
3,797,506 A 3/1974 Reinsch
(Continued)

FOREIGN PATENT DOCUMENTS

CN 107518563 A * 12/2017 ..... A45D 24/007
CN 108741567 A 11/2018
(Continued)

OTHER PUBLICATIONS

CN 107518563 machine translation (Year: 2017).*
(Continued)

*Primary Examiner* — Heidi M Eide
*Assistant Examiner* — Courtney N Huynh
(74) *Attorney, Agent, or Firm* — CHRISTENSEN O'CONNOR JOHNSON KINDNESS PLLC

(57) ABSTRACT

The applicator for applying a haircare product comprises a base 12 and spikes 14 protruding with respect to the base. At least a plurality of spikes 14 each have a cross section of elongate shape in at least one direction of extension. At least some of the spikes of said plurality of spikes are made at least partially of porous material that is able to absorb said haircare product.

13 Claims, 4 Drawing Sheets

(51) Int. Cl.

| | |
|---|---|
| ***A45D 24/22*** | (2006.01) |
| ***A46B 9/02*** | (2006.01) |
| ***A46B 15/00*** | (2006.01) |
| *A45D 7/00* | (2006.01) |

(52) U.S. Cl.
CPC ..... *A46B 9/023* (2013.01); *A46B 15/0004* (2013.01); *A45D 2007/002* (2013.01); *A46B 2200/104* (2013.01)

(56) References Cited

U.S. PATENT DOCUMENTS

| | | | | |
|---|---|---|---|---|
| 5,062,435 | A * | 11/1991 | Ohtsuka | A45D 24/30 132/108 |
| 5,076,298 | A * | 12/1991 | Busch | A45D 24/22 401/47 |
| 2011/0041269 | A1* | 2/2011 | Iwahori | A46B 15/0006 15/22.1 |
| 2011/0164914 | A1 | 7/2011 | Caulier | |
| 2013/0340781 | A1 | 12/2013 | Liebel et al. | |
| 2016/0100681 | A1* | 4/2016 | Smal | A45D 6/04 132/238 |
| 2017/0020276 | A1* | 1/2017 | Brewer | A46B 13/008 |
| 2017/0238670 | A1* | 8/2017 | Mercier | A45D 20/48 |
| 2019/0098974 | A1* | 4/2019 | Grez | A45D 24/26 |
| 2021/0204668 | A1* | 7/2021 | To | A45D 2/00 |

FOREIGN PATENT DOCUMENTS

| | | | | |
|---|---|---|---|---|
| DE | 38 42 006 | A1 | 6/1990 | |
| DE | 94 12 321 | U1 | 10/1994 | |
| EP | 0687426 | A1 * | 12/1995 | A45D 24/007 |
| EP | 1092361 | A1 * | 4/2001 | A45D 24/22 |
| GB | 250 437 | A | 4/1926 | |
| WO | 2011/045770 | A1 | 4/2011 | |

OTHER PUBLICATIONS

EP-0687426-A1. (Moser Feinmechanik) (Reiners Christa; Reiners Bernd) Manual device for combing hair, Dec. 20, 1995 [retrieved on Aug. 21, 2024]. Translation retrieved from: Espacenet (Year: 1995).*

Mitch. Hair Mousse how-to: The correct way to use it [online]. All things Hair, Aug. 31, 2017 [retrieved on Feb. 14, 2025]. Retrieved from the Internet: URL:<https://www.allthingshair.com/en-ph/hair-products/hair-mousse/how-to-use-hair-mousse/> (Year: 2017).*

International Search Report and Written Opinion mailed Aug. 21, 2020, issued in corresponding International Application No. PCT/EP2020/064329, filed May 22, 2020, 15 pages.

* cited by examiner

APPLICATOR FOR APPLYING A HAIRCARE PRODUCT, AND ASSOCIATED APPLICATION METHOD

CROSS-REFERENCES TO RELATED APPLICATIONS

This application is a National Stage of International Application No. PCT/EP2020/064329 filed May 22, 2020, which claims priority to French Patent Application No. 1905430 filed May 23, 2019, the entire disclosures of which are hereby incorporated by reference.

TECHNICAL FIELD

The present invention relates to an applicator for applying a haircare product, in particular a hairstyling composition comprising a fixing agent for shaping the hair.

BACKGROUND

Generally, in order to shape a head of hair, the arrangement of the hair is changed and then the conferred shape is fixed.

It is particularly difficult for people involved in strenuous physical activity to shape their hair. In general, they style themselves by putting their hair back and then tying it up. This leaves little room for variations in hairstyle, causing frustration for some of these people. If they do not wish to tie their hair up, they can use fixing products such as gels or lacquers.

Gels produce a strand-like effect that is associated with male hairstyles. Therefore, women generally prefer to use lacquers. These are dispensed by aerosol systems that deliver droplets of product propelled by a gas, generally a liquefied gas, based on an alcoholic or aqueous solution and polymer resins, forming joins between the individual hairs after drying.

However, in the case of strenuous physical activity, the application of a lacquer is not enough to hold the hairstyle. This is because some strands still tend to come away from the rest of the hairstyle, having a negative effect on the appearance of the hairstyle and/or possibly bothering the person.

To remedy this problem, it is possible to increase the application time of the aerosol lacquer, for example to 30 seconds, or even to a minute. This solution may be suitable only in the case of a short period of physical activity, for example less than an hour. Furthermore, if the person requires this type of fixing regularly, this solution turns out to be expensive, damages the hair, and requires a fairly long disentangling time. In addition, the product can pass under the first layers of hair and give rise to a feeling of the scalp being smothered.

Another solution is to combine the lacquer with the use of hair clips. However, this solution also has draw backs.

This is because the hair clips are attached after the lacquer has been applied, the fitting of the clips moves the hair and thus breaks some of the joins between the individual hairs. By contrast, if the lacquer is applied after the hair clips have been fitted, the clips become fixed to the hair, and this can make it difficult to subsequently remove them.

In order to benefit from a device that makes it possible to deposit droplets of fixing composition without spraying, the Applicant Company has developed an applicator comprising a plurality of protruding spikes that delimit, at their free ends, cavities for retaining the composition to be applied.

For more details on the design of this applicator, reference may be made to the Patent Application WO-A2-2012/107887, and in particular to the embodiments in FIGS. 2F, 3F and 3G.

Once the cavities of the spikes of the applicator have been loaded with composition by direct withdrawal from a container containing the composition, the composition is retained inside said cavities by capillary action before being deposited on the hair in the form of droplets.

Such an applicator makes it possible in particular to achieve precise application of composition without running. However, this applicator is not suitable for fixing the hairstyle in the case of a strenuous physical activity. In this context, in order to prevent the strands from coming away from the rest of the hair, it is once again possible to apply a larger amount of composition. However, here too, this solution is not satisfactory if the person requires this type of fixing on a regular basis.

It will therefore be understood that there is a need to remedy the abovementioned draw backs.

SUMMARY

According to a first aspect, a subject of the invention is an applicator for applying a haircare product, comprising a base and spikes protruding with respect to the base.

According to a general feature, at least a plurality of spikes each have a cross section of elongate shape in at least one direction of extension. At least some of the spikes of said plurality of spikes are made at least partially of porous material that is able to absorb said haircare product.

All of said spikes can be made at least partially of porous material. Alternatively, only some of the spikes of said plurality of spikes may be made at least partially of porous material.

According to a second aspect, a subject of the invention is an applicator for applying a haircare product, comprising a base and spikes protruding with respect to the base.

According to a general feature, at least a plurality of spikes each have a cross section of elongate shape in at least one direction of extension.

The term "spikes" is understood to mean separable protruding elements on the applicator. The term "cross section" of a spike is understood to mean a section of the spike in a plane perpendicular to its height.

With the particular configuration of the spikes, after the applied product has dried, individual joins of said product of elongate shape are obtained, making it possible to fix together a larger number of individual hairs than conventional applicators. This increases the fixing power of each individual join and thus that of the final fixing. The design of the spikes thus makes it possible to obtain fixing of the hairstyle that is suitable for intense physical activity.

The increase in the fixing power of each individual join does not otherwise produce disentangling difficulties, unlike in the case of extended application of lacquers. This is because, for a spike in question, since its cross section is elongate in at least one direction of extension, the dimension of the spike along an axis of greatest width is reduced compared with the dimension along an intersecting axis of greatest length.

The term "porous material" is understood to mean a material that is permeable to the composition, that is to say one that allows the composition to diffuse inside it. At least the end parts of the spikes are formed at least partially from porous material. It is for example possible to provide for only the end parts of the spikes to be made from porous material. Alternatively, each spike may be formed entirely from porous material. In another variant, the applicator as a whole may be formed entirely from porous material. Preferably, said porous material of the spikes of the applicator comprises foam. The foam may be for example a polyurethane foam or a polyethylene foam. The foam may have open or semi-open cells. By way of indication, the density of the foam may be less than or equal to 0.8, and may preferably be between 0.1 and 0.6.

By way of indication, a spike of elongate cross section may have a length D along the axis of greatest length of at least 1 mm, better still at least 3 mm, and preferably at least 8 mm. At its most, this length may be for example 100 mm.

Likewise by way of indication, the spike may have a width d along the axis of greatest width of less than 10 mm, and preferably less than 2 mm. At its least, this width may be for example 0.3 mm.

Preferably, the length D is at least two times greater, and preferably four times greater, than the width d.

In one embodiment, all of the spikes of the applicator each have a cross section of elongate shape. Alternatively, only some of the spikes of the applicator may have a cross section of elongate shape, the rest of the spikes having a cross section that is not elongate, for example circular or square.

The spikes of said plurality of spikes may be arranged in a mutually parallel manner.

According to one particular design, at least some of the spikes of said plurality of spikes are mounted in a fixed manner relative to the base. In this case, the spikes may be integral with the base or alternatively be made in the form of attached elements fixed to the base by any appropriate means, for example by adhesive bonding or by overmoulding.

According to another design, at least some of the spikes of said plurality of spikes are able to be oriented angularly relative to the base about the axis of extension thereof. Preferably, the spikes are able to be oriented jointly.

The applicator may comprise a member for adjusting the angular orientation of the spikes. In one embodiment, the applicator also comprises a sensor for measuring the speed or acceleration of said applicator, and a control unit that is able to control the operation of the member for adjusting the angular orientation of the spikes depending on the data from said measurement sensor.

At least a plurality of spikes may each have a cross section of elongate shape in at least two directions of extension.

In one embodiment, the base of the applicator delimits a frontal face with respect to which the spikes protrude, the density of spikes on said frontal face being between 0.1 and 20 per $cm^2$, and preferably between 1 and 5 per $cm^2$.

Said frontal face of the base of the applicator may be between 10 and 1000 $cm^2$, and preferably between 50 and 400 $cm^2$. The total number of spikes may vary from 20 to 20 000, better still from 50 to 10 000, and preferably from 100 to 2000.

Preferably, the spikes extend in the same direction of extension and are also preferably the same height. In order to promote uniform application of the composition, the spikes may be identical to one another. The spikes may have for example a constant cross section over their entire height or, on the contrary, a section that is variable along their height.

By way of indication, the height of the spikes may be for example between 10 mm and 40 mm, and preferably between 12 mm and 30 mm.

In one particular embodiment, the end parts of the spikes have a flat shape or a section that decreases in the direction of their free end. In a variant, it is possible to provide end parts for the spikes having other shapes, for example a concave shape so as to form cavities for retaining the product, a wavy shape, etc.

In one particular embodiment, the applicator comprises a reservoir that is integrated with the base and delimits on the inside at least one storage compartment for the product to be applied. The spikes of the applicator may each delimit on the inside a product feed duct that opens out via at least one outlet orifice and is in fluidic communication with the reservoir. The outlet orifices may be provided on the end parts of the spikes, in particular at their free ends.

The expression "reservoir integrated with the base" is understood to mean that the reservoir is fixed to the base, or that the reservoir is made in one piece with the base, for example by moulding.

The reservoir may comprise at least one deformable part such that pressure exerted on said deformable part causes the volume of said storage compartment to be reduced and the product to move towards the feed ducts and the outlet orifices of the spikes.

The deformable part(s) may be elastically deformable. The expression "elastically deformable part" is understood to mean a part that is capable, on account of the material used and/or the dimensioning thereof, of deforming under the action of a load exerted on said part by the user, and of returning to its initial position by elasticity once the load ceases. Alternatively, it is possible for the deformable part(s) not to revert to their original shape after deformation.

The reservoir may delimit on the inside a plurality of storage compartments that are each in fluidic communication with at least one of the feed ducts of the spikes, each feed duct being in communication with only one of said compartments. It is possible to provide for each storage compartment to be fluidically isolated from the other storage compartment(s). Thus, the different storage compartments can be filled with different products and/or filled with different quantities of product.

According to one particular design, the applicator comprises a plurality of elastically compressible porous members disposed inside said storage compartment. Such porous members make it possible to absorb the product and to release it when they are compressed.

Preferably, each porous member covers the inlet orifice(s) of the feed ducts of the spikes that open into said compartment. This thus makes it possible to avoid product getting between the porous members and the base.

In one particular embodiment, the applicator may comprise a system for distributing said pressure on each elastically compressible porous member, the system being mounted inside the reservoir. The distribution system may comprise a plurality of resilient members that are each interposed between a porous member and the deformable wall. The resilient members may be for example springs.

In one embodiment, the applicator may also comprise a system for adjusting the flow rate of the feed ducts of the spikes that is mounted inside the reservoir and is actuable from the outside. The adjusting system makes it possible to adjust the flow rate of each spike and to close them off after the applicator has been used.

In one particular embodiment, at least a plurality of spikes each have a surface tension that is variable along the length thereof, a distal application part of each spike of said plurality of spikes having a surface tension greater than that of a proximal part of said spike.

The "proximal part" of a spike is understood to mean the part of the spike that is closest to the base, and the "distal part" is understood to mean the end part of the spike that is furthest from the base while being situated on the same side as the proximal part relative to the base. The distal application part of each spike of said plurality of spikes may be adjacent to the proximal part of said spike.

The distal parts of the spikes may have one or more surface tension values. The proximal parts of the spikes may have one or more surface tension values that remain lower than that (those) of the distal parts.

The surface tension values of the distal application parts and of the proximal parts of the spikes are advantageously chosen depending on the haircare product to be applied.

The surface tension of the distal application parts of the spikes may advantageously be greater than that of the haircare product to be applied. The surface tension of the proximal parts of the spikes may advantageously be lower than that of the haircare product to be applied.

During the loading of the spikes of the applicator with the haircare product, a layer of haircare product is formed on each spike. Then, before and during the introduction of the applicator into the head of hair such that the spikes penetrate under the first layer of the hair, the haircare product tends to move towards the ends of the spikes given the surface tension of the distal application parts and of the proximal parts of said spikes relative to the surface tension of the haircare product.

Thus, the haircare product is deposited mainly on the layer of hair that is situated under the first layer of the hair without necessarily treating the entire volume of the hair, that is to say without treating either the first layer of hair or the internal layer of hair that is located in the immediate vicinity of the scalp.

The deposited product may dry relatively quickly given that it is situated close to the external surface of the first layer of the hair.

Preferably, the distal application part of each spike of said plurality of spikes is provided with the free end of said spike.

According to one particular design, the distal application part and proximal part of each spike of said plurality of spikes are fixed relative to one another.

With such a design, the distal application part and proximal part of each spike may be made in one piece. In this case, it is possible to locally provide a step of surface treatment of each spike in order to reduce the surface tension of the proximal part. Alternatively, it is possible to produce the distal application part and proximal part of each spike as two separate pieces, which are then fixed together by any appropriate means. In another variant, each spike of said plurality of spikes is provided with a sleeve delimiting the proximal part of said spike.

According to another particular design, the distal application part and proximal part of each spike of said plurality of spikes are able to slide relative to one another, and are mounted partially one inside the other.

In this case, the applicator may also comprise an actuating member for the movement of the distal application part and proximal part of each spike of said plurality of spikes relative to one another.

In one embodiment, the actuating member comprises a plate that is movable relative to the base and that supports the proximal part, or the distal application part, of each spike of said plurality of spikes. The applicator may also comprise at least one elastically deformable return element that is interposed between the plate and the base.

A further subject of the invention is a method for applying a hairstyling composition comprising at least one fixing agent to the hair with the aid of an applicator that comprises a base and spikes protruding with respect to the base, at least a plurality of spikes each having a cross section of elongate shape in at least one direction of extension.

The method comprises:

- a step of loading the spikes of the applicator with the hairstyling composition, and
- a step of transferring the hairstyling composition retained on the spikes of the applicator to the hair, wherein the spikes of said plurality of spikes are oriented such that said direction of extension of the cross section of several spikes forms a non-zero angle with the direction of extension of the hair.

Such an orientation promotes the obtaining, after drying, of individual joins that fix a large number of adjacent hairs together. By way of indication, the angle formed between said direction of extension of the cross section of the spikes and the direction of extension of the hair can be for example greater than 30° and preferably greater than 60°, and preferably around 90°.

During the step of transferring the hairstyling composition to the hair, it is possible to tap the spikes of said plurality of spikes on the hair.

The expression "tapping the spikes of the applicator on the hair" is understood to mean the action of applying the spikes several times to the area of the hair to be treated, using a back and forth movement. The transfer can thus take place by capillary action by simple contact.

This type of application does not destroy the hairstyle and, without the applicator being rubbed along the hair, makes it possible to obtain a very high quality fixing effect. Preferably, the step of transferring the hairstyling composition to the hair is realized by directly tapping the spikes of the applicator on the hair.

For the variant of the applicator in which the spikes, or the parts at which the feed ducts open out, are made from porous material, the transfer can also be effected by pressing the porous material against the hair in order to deform it and release the product.

In one particular embodiment, in order to promote the transfer of the composition, it is possible to add an external mechanical action that assists this transfer. This mechanical action may be brought about for example by a vibration generator mounted on the applicator, for example a piezoelectric element or a flyweight driven in rotation, by a pressure source, or be a thermal or electric phenomenon.

The method according to the invention may be implemented on dry hair or wet hair. Preferably, the hair is dry.

After the composition has been transferred onto the hair, the applicator can be moved away and the composition deposited on the hair dried, for example with the aid of a hair dryer or heating hood, or left to dry naturally.

As indicated above, the method comprises a prior step that consists in loading the spikes of the applicator with the hairstyling composition to be applied.

The applicator can be loaded with composition before each use.

The composition may be withdrawn directly from a container containing the composition by the spikes of the applicator. In one alternative, the spikes of the applicator may for example be pressed onto a sponge impregnated with composition, in order to be loaded with composition. In a variant, the applicator is dipped in the composition. The applicator may also be brought into contact with a roller loaded with composition. In the variant in which the applicator comprises a reservoir, the spikes are loaded with composition by pressure on the deformable part(s) of this reservoir.

Preferably, the applicator may be cleaned after use and the composition remaining on the applicator after use can be removed easily, cleaning being carried out for example with water or with the aid of any suitable solvent, by using an absorbent fabric, by aspiration or by gas jet, etc. When the spikes are made from porous material, these spikes are pressed so that they are completely emptied of composition.

The fact that the applicator is reloadable with composition allows it to be reused.

The applicator is reloaded for example with a composition identical to the composition used previously, or it can be loaded with a different composition.

The loading of the applicator with composition may involve the removal of excess composition from the applicator so that the composition is not present anywhere other than on the spikes.

The compositions that can be used are in the form of liquids or gels, creams, pastes, which may or may not comprise a pulverulent phase, or powder. When the composition is liquid, it may be in the form of a lotion or emulsion.

The composition may be in the form of a liquid, a lotion or a fluid emulsion or a gel that is not very thick.

The viscosity of the composition varies preferably from 1 to 200 cps at 25° C. and at a shear rate of 1 $s^{-1}$. The viscosity measurements to which reference is made are taken using a rheometer with cone-plate geometry.

In particular, a composition known to a person skilled in the art for styling and fixing the hair may be chosen, in particular those that are introduced into aerosol devices in the presence of a propellant gas so as to be used in lacquer form. It is also possible to use a composition inspired by these compositions but superconcentrated in fixing active agent.

The composition comprises at least one fixing agent, if necessary in a cosmetically acceptable medium, the latter preferably being water-, alcohol- or aqueous alcohol-based.

The cosmetic composition may in particular comprise one or more organic solvents, preferably in an amount by mass of between 0.05 and 95%, very preferably between 1 and 70% by weight, relative to the total weight of the composition.

This organic solvent may be a $C_2$ to $C_4$ lower alcohol, in particular ethanol and isopropanol, polyols and polyol ethers such as propylene glycol, polyethylene glycol or glycerol. The organic solvent is preferably ethanol or isopropanol, and even more preferably is ethanol.

The composition may comprise one or more fixing polymers as fixing agent. The expression "fixing polymer" is understood to mean any polymer that makes it possible to give a shape to the hair or to hold the hair in a given shape.

All the anionic, cationic, amphoteric and nonionic fixing polymers and mixtures thereof that are used may be used as fixing polymers in the compositions to be applied to the hair using the method of the invention. For more details on the fixing polymers that can be used, reference may be made to the abovementioned Patent Application WO-A2-2012/107887.

As regards the applicator, it may be rigid, semi-rigid or flexible. The base of the applicator may be rigid, semi-rigid or flexible. The base is preferably made of a non-absorbent material. The term "non-absorbent" is understood to mean intrinsically impermeable to the composition, that is to say not allowing the diffusion of the composition inside it. The non-absorbent material may be for example a metallic or thermoplastic material, in particular chosen from polyolefins, polyamides including nylons, and polyester.

By way of indication, the base of the applicator may have a transverse dimension of a few centimetres, or be much larger in order to cover a large part of the head in a single action.

DESCRIPTION OF THE DRAWINGS

The present invention will be understood better from studying the detailed description of embodiments that are given by way of entirely non-limiting example and are illustrated by the appended drawings, in which.

DETAILED DESCRIPTION

Figure 1:
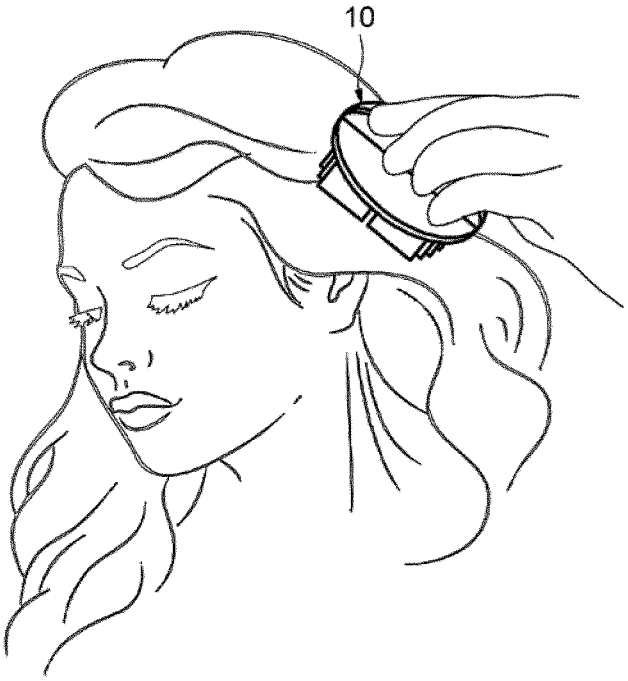
FIG. 1 illustrates an application method according to one implementation example of the invention.

The method according to the invention can be implemented directly by the consumer in order to arrange or touch up their hairstyle, as is illustrated in FIG. 1. Alternatively, the method can be implemented in a professional setting.

The method of the invention is implemented with the aid of an applicator 10 for applying a hairstyling composition comprising at least one fixing agent to the consumer's hair. As will be described in more detail below, the composition is transferred from the applicator 10 to the hair advantageously with a particular orientation with respect to the head of hair. The applicator 10 is pre-loaded with composition to be applied before the step of transferring it to the hair.

Figure 2:
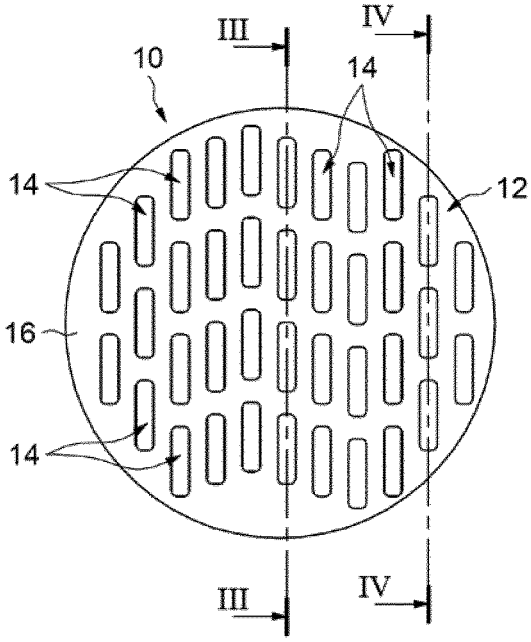
FIG. 2 is a front view of an applicator according to one exemplary embodiment of the invention, which is used in the application method in FIG. 1.
Figure 3:
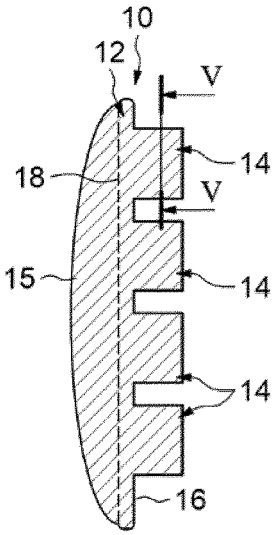
FIG. 3 is a view in cross section of the axes III-III of FIG. 2.
Figure 4:
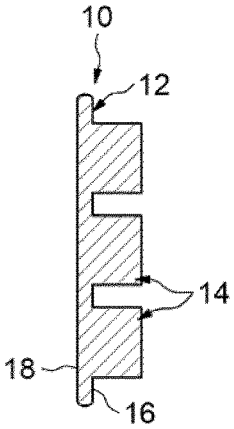
FIG. 4 is another view in cross section on the axes IV-IV in FIG. 2.

As illustrated more clearly in FIGS. 2 to 4, the applicator 10 comprises a base 12 and a plurality of spikes 14 extending therefrom. As will be described in more detail below; each spike 14 of the applicator 10 has a cross section of elongate shape.

In the illustrated example, the applicator 10 also comprises a tab 15 to make it easier to grip and handle. The tab 15 extends from the base 12 on the opposite side from the spikes 14. Alternatively, it is possible for the applicator 10 not to have such a tab.

The base 12 has a cylindrical overall shape. In a variant, it is possible to provide other shapes, for example polygonal, oval, etc., for the base.

The spikes 14 make it possible to apply the composition to the consumer's hair. The spikes 14 extend transversely with respect to the base 12. The axes of extension of the spikes 14 are mutually parallel. The spikes 14 are preferably identical to one another. The spikes 14 extend from a frontal face 16 of the base 12.

The base 12 is delimited axially by the first frontal face 16 and by a second frontal face 18 on the opposite side from the first frontal face 16. The frontal faces 16, 18 form end faces of the base 12. The frontal faces 16, 18 are in this case flat. In a variant, these faces could be slightly convex or concave.

In the illustrated example, the spikes 14 are spaced apart regularly from one another. Depending on the spacing of the spikes 14, the fixing effect of one and the same composition will be different. By way of indication, the spacing or distance between the spikes 14 may be between 2 mm and 8 mm. Alternatively, it might be possible to provide an inter-spike 14 spacing that is not regular, for example when the composition is intended to be deposited in a particular pattern.

In the illustrated example, the spikes 14 are arranged in a mutually parallel manner and extend in the same direction. Alternatively, the spikes can be arranged so as to form at least two groups such that the spikes of one and the same group extend in the same direction and in a different direction from the spikes of the other group.

Figure 5:
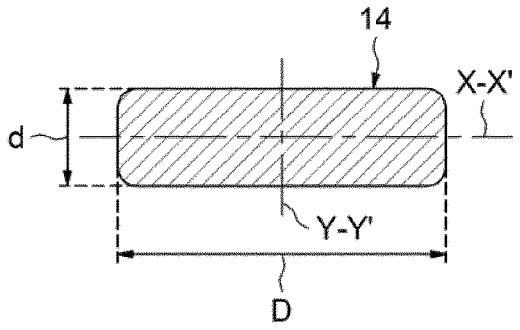
FIG. 5 is a view in cross section on the axis V-V in FIG. 3, illustrating the cross section of a spike of the applicator.

As indicated above and as is illustrated in FIG. 5, each spike 14 has a cross section of elongate shape along an axis X-X' of greatest length. The axis X-X' extends perpendicularly to the axis of the base.

The cross section of the spike 14 is in this case rectangular. The cross section of the spike 14 has a length D along the axis X-X' and a width d along an axis Y-Y' of greatest width perpendicular to said axis X-X', where preferably D>2d, and in particular D>4d. In the illustrated example, given the rectangular shape of the cross section of the spike 14, the axis X-X' of greatest length is coincident with or parallel to one of the long sides of the rectangle and the axis Y-Y' of greatest width is coincident with or parallel to one of the short sides of the rectangle.

Figure 6A:
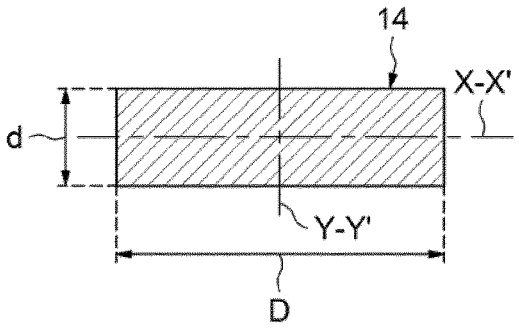
FIG. 6*a* is a view in cross-section of spikes of applicators according to further exemplary embodiments of the invention.

In the illustrated example, the cross section of the spike 14 is rectangular with rounded corners. In a variant, as is illustrated in FIG. 6*a*, the cross section of the spikes 14 may be rectangular with right-angled corners. Alternatively, it is possible to provide other polygonal shapes, for example in the form of a triangle, lozenge, parallelogram, etc. for the elongate cross section of the spikes 14.

Figure 6B:
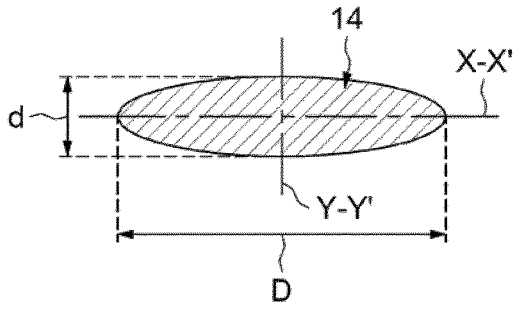
FIG. 6*b* is a view in cross-section of spikes of applicators according to further exemplary embodiments of the invention.
Figure 6C:
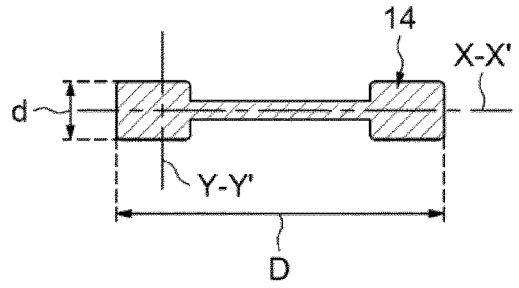
FIG. 6*c* is a view in cross-section of spikes of applicators according to further exemplary embodiments of the invention.

The cross section of elongate shape of the spikes 14 may have shapes other than polygonal, for example elliptical or oval, as is illustrated in FIG. 6*b*. In another variant, the cross section of the spikes 14 may be in the form of a dumbbell as illustrated in FIG. 6*c*, or in the form of an hourglass, etc.

Figure 6D:
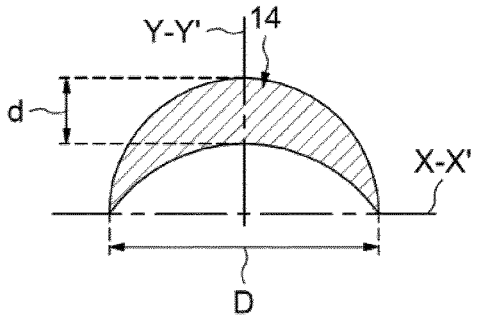
FIG. 6*d* is a view in cross-section of spikes of applicators according to further exemplary embodiments of the invention.
Figure 6E:
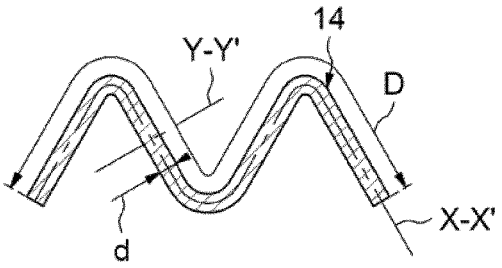
FIG. 6*e* is a view in cross-section of spikes of applicators according to further exemplary embodiments of the invention.

The cross section of elongate shape of the spikes 14 may also have other shapes, for example in the form of a crescent moon as is illustrated in FIG. 6*d*, or a wavy shape as illustrated in FIG. 6*e*. In the illustrated example in FIG. 6*d*, the axis X-X' of greatest length is in the form of a circular arc, and in the illustrated example in FIG. 6*e*, the axis X-X' of greatest length has a wavy shape.

By way of indication, the spikes 14 can have a length D along the axis of greatest length of at least 1 mm, better still at least 3 mm, and preferably at least 8 mm. The spikes 14 can have a width d along the axis of greatest width of less than 10 mm, and preferably less than 2 mm. It is possible to provide a height of between 10 mm and 40 mm, and preferably between 12 mm and 30 mm, for the spikes.

The applicator 10 can be made by moulding a rigid plastics material, for example PP, PE, HDPE, etc., or a flexible plastics material. In the illustrated example, the applicator 10 is made by moulding in one piece. The spikes 14 are made integrally with the base 12. Alternatively, the spikes 14 could be produced in the form of attached elements that are fixed to the base 12 by any appropriate means, for example by adhesive bonding or by overmoulding. In this case, at least some of the spikes 14 may be made at least partially from porous material that is able to absorb said haircare product.

To effect application to the hair, the user can proceed as follows.

First of all, the user loads the spikes 14 of the applicator with composition, for example by dipping them into a container containing the composition. In this way, a layer of composition covers each of the spikes 14.

Next, in a second step, the user positions the applicator 10 relative to the head of hair such that the direction of extension of the cross section of the spikes 14 is not aligned with the direction of extension of the hair. For example, the angle formed between this direction of extension of the cross section of the spikes 14 and the direction of extension of the hair can be for example greater than 30° and preferably greater than 60°. Optimally, the angle formed between the direction of extension of the cross section of the spikes 14 and the direction of extension of the hair is around 90° in order for it to be possible to fix a maximum number of adjacent hairs.

Finally, in a third step, the user brings the spikes 14 of the applicator into contact with the hair by introducing them into the thickness of the head of hair in order to apply the product by capillary action. During this step, the user can lightly tap the spikes against the hair in order to facilitate the deposition of the composition on the head of hair.

Independently of the application of composition, the user can also make use of the applicator not loaded with composition in order to style or restyle their hair. In this case, the user positions the applicator 10 such that the direction of extension of the cross section of the spikes 14 is in the direction of extension of the hair.

In the above illustrated examples, the cross section of the spikes 14 is elongate in a single direction of extension. Alternatively, it is possible to provide for the spikes 14 a cross section that is elongate in at least two directions of extension, as is illustrated in FIGS. 7*a* to 7*d*.

Figure 7A:
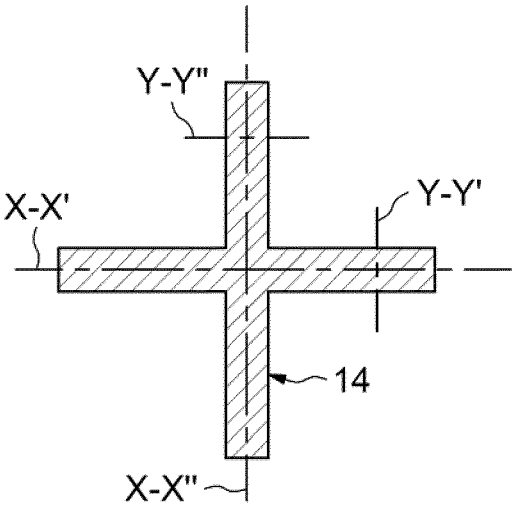
FIG. 7*a* is another view in cross-section of spikes of applicators according to further exemplary embodiments of the invention.

In the example in FIG. 7*a*, the cross section of the spike 14 is elongate in two perpendicular directions in the form of a cross. The axes X-X' and Y-Y' form the axes of greatest length and of greatest width of one direction of extension of the cross section, and the axes X-X" and Y-Y" form the axes of greatest length and of greatest width of the other direction of extension.

Figure 7B:
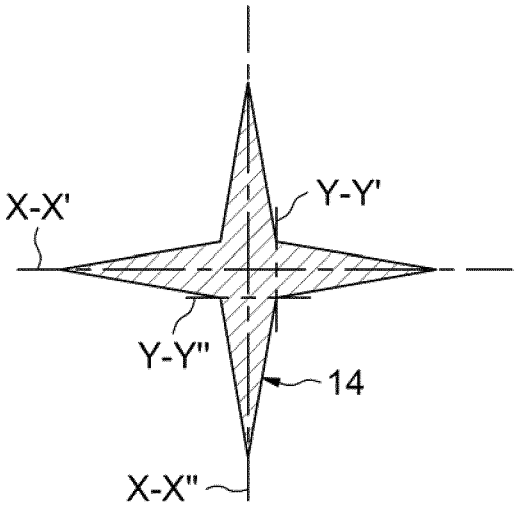
FIG. 7*b* is a view in cross-section of spikes of applicators according to further exemplary embodiments of the invention.
Figure 7C:
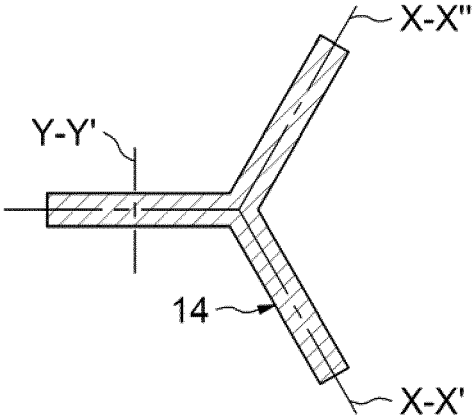
FIG. 7*c* is a view in cross-section of spikes of applicators according to further exemplary embodiments of the invention, FIG. 7*d* are views is a view in cross section illustrating the cross section of spikes of applicators according to further exemplary embodiments of the invention.
Figure 7D:
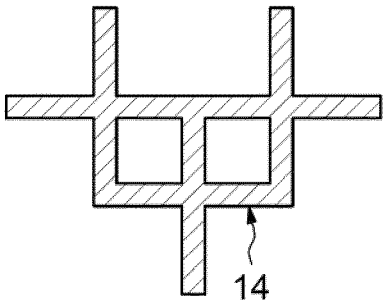

In each of the illustrated examples illustrated in FIGS. 7*b* and 7*c*, the cross section of the spike 14 is elongate in two perpendicular directions in the form of a star. In the illustrated example in FIG. 7*d*, the cross section of the spike 14 is elongate in three perpendicular directions in the form of a grid. In a variant, it is possible to provide other types of elongate cross section for the spikes 14.

With this type of design, in which the cross section of the spikes 14 is elongate in several directions, it is not necessary to orient the spikes relative to the head of hair before applying product. This type of design is furthermore advantageous for heads of hair in which the hairs extend in several directions.

Figure 8:
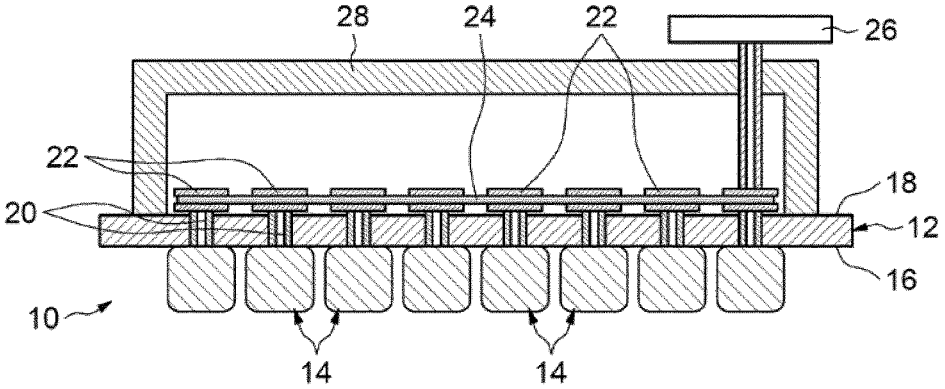
FIG. 8 is a view in cross section of an applicator according to another exemplary embodiment of the invention.
Figure 9:
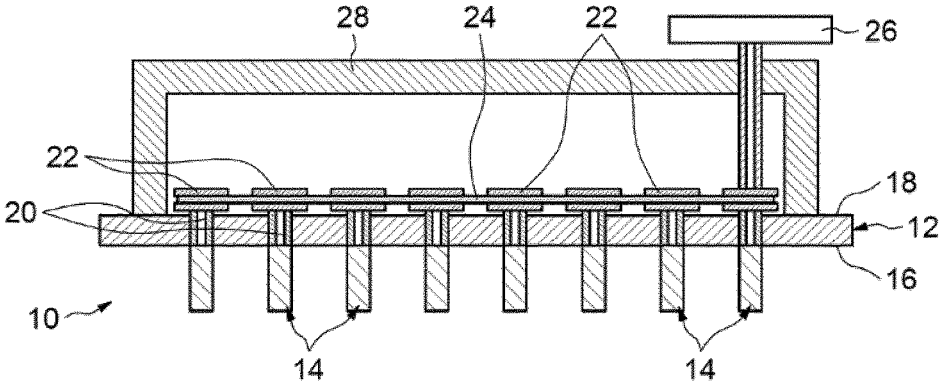
FIG. 9 is a view in cross section of an applicator according to another exemplary embodiment of the invention.

In the above illustrated examples, the spikes 14 are mounted in a fixed manner with respect to the base 12. In a variant, it is possible for the spikes to be mounted in a movable manner relative to the base, for example as is illustrated in the illustrated example illustrated in FIGS. 8 and 9, in which identical elements bear the same references.

In this example, each spike 14 of the applicator is mounted on a shaft 20 extending through the base 12. Each shaft 20 protrudes from the frontal face 16 of the base and supports the associated spike 14 at its free end. The spike 14 can be fixed to the associated shaft 20 by any appropriate means. In a variant, it is also possible to make the spike 14 and the shaft 20 in one piece.

In the illustrated example, the applicator 10 comprises a plurality of pulleys 22 that are each fixed to one of the shafts 20 on the opposite side from the spikes 14 with respect to the base 12. The applicator 10 also comprises a belt 24 for driving the pulleys 22 in rotation, and an actuating wheel 26 that is connected to one of the pulley's 22, thereby forming a driving pulley. The applicator 10 comprises a case 28 fixed to the frontal face 18 of the base and inside which the pulleys 22 and the belt 24 are housed. The wheel 26 extends out of the case 28. In an alternative example, the belt 24 can be replaced by gears.

Figure 10:
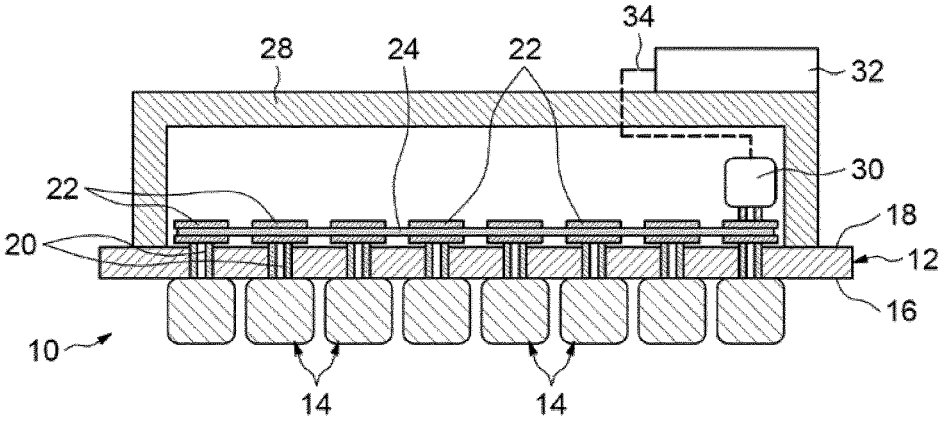
FIG. 10 is a view in cross section of an applicator according to yet another exemplary embodiment of the invention.

The angular orientation of the spikes 14 relative to the base 12 is controlled manually by the user via the wheel 26. In a variant, the angular movement of the spikes 14 relative to the base 12 may be controlled in an assisted manner, with a motor 30 as is illustrated in the illustrated example in FIG. 10, in which identical elements bear the same references. The motor 30 makes it possible to drive one of the pulleys 22, which forms the driving pulley, in rotation, the other pulleys being driven in rotation under the effect of the motor via the belt 24. The motor 30 is mounted inside the case 28. The motor 30 may be for example an electric stepper motor.

In this illustrated example, the applicator 10 also comprises an electronic control unit 32 for controlling the operation of the motor 30. To this end, the applicator 10 comprises a sensor (not shown) for measuring the acceleration of said applicator. The measurement sensor is connected to the control unit 32 via a connection, for example of the wired or wireless type. The control unit 32 is connected to the motor 30 via a connection 34, depicted schematically, that may also be of the wired or wireless type. The control unit 32 and the measurement sensor are fixed to the case 28.

The control unit 32 is able to control the operation of the motor 30 depending on signals output by the measurement sensor, for example in order to orient the spikes 14 such that they take up an orientation aligned with or perpendicular to the direction of extension of the hair.

Typically, when the measurement sensor transmits data corresponding to a movement of the applicator to the control unit 32, the control unit 32 controls the operation of the motor 30 so as to orient the spikes 14 in a predetermined manner with respect to the base, which corresponds to an orientation aligned with the direction of extension of the hair. When the measurement sensor transmits data corresponding to stopping of the applicator to the control unit 32, the control unit 32 controls the operation of the motor 30 so as to pivot the spikes 14 and orient them in a manner perpendicular to the direction of extension of the hair. The control unit 32 can also be programmed to detect when the applicator 10 is moved along an axis perpendicular to its first movement, meaning that the movement of the applicator is no longer along the hair but dipping towards the head of hair. In this case, the control unit 32 controls the operation of the motor 30 so as to orient the spikes 14 perpendicularly to the direction of extension of the hair.

In the illustrated examples described, the spikes 14 of the applicator are fixed or able to be oriented angularly with respect to the base. In a variant, it is possible to provide an applicator comprising both, fixed and movable, types of spikes.

The invention claimed is:

1. Applicator for applying a haircare product, comprising a base and spikes protruding with respect to the base and each extending along an axis of extension, wherein all of the spikes each have a cross section of elongate shape in at least one direction of extension of said cross section, wherein all of the spikes are each able to be oriented angularly relative to the base about the axis of extension of the spikes, wherein said applicator comprises a member for driving the spikes in rotation, and wherein said applicator also comprises a measurement sensor configured to measure the speed or acceleration of said applicator, and a control unit that is able to control the operation of the member for adjusting the angular orientation of the spikes about the spike's axis of extension thereof depending on data from said measurement sensor in order to orient the spikes such that the spikes take up an orientation aligned with or perpendicular to a direction of extension of hair, wherein when the measurement sensor transmits data corresponding to a movement of the applicator, the control unit controls the operation of the member for driving simultaneously the spikes in the same direction in rotation so as to orient the spikes in an orientation aligned with the direction of extension of the hair, and wherein when the measurement sensor transmits data corresponding to stopping of the applicator, the control unit controls the operation of the member for driving the spikes so as to orient the spikes in a manner perpendicular to the direction of extension of the hair.

2. Applicator according to claim 1, wherein the cross section of each of the spikes has a length along an axis of greatest length of said direction of extension, and a width along an axis of greatest width intersecting said axis of greatest length, the length being at least two times greater, and preferably four times greater, than the width.

3. Applicator according to claim 2, wherein said length is at least equal to 3 mm, and preferably at least equal to 8 mm.

4. Applicator according to claim 1, wherein the spikes are arranged in a mutually parallel manner.

5. Applicator according to claim 1, wherein at least a plurality of the spikes each have a cross section of elongate shape in at least two directions of extension.

6. Applicator according to claim 1, wherein the base delimits a frontal face with respect to which the spikes protrude, the density of spikes on said frontal face being between 0.1 and 20 per $cm^2$, and preferably between 1 and 5 per $cm^2$.

7. Applicator according to claim 6, wherein the frontal face of the base of the applicator is between 10 and 1000 $cm^2$, and preferably between 50 and 400 $cm^2$.

8. Applicator according to claim 1, wherein a total number of the spikes is between 20 and 20 000.

9. Method for applying a hairstyling composition comprising at least one fixing agent to hair with the aid of an applicator according to claim 1, comprising:

a step of loading the spikes of the applicator with a hairstyling composition, and a step of transferring the hairstyling composition retained on the spikes of the applicator to the hair, wherein the spikes are oriented together in the same direction such that said direction of extension of the cross section of all the spikes form a non-zero angle with a direction of extension of the hair.

10. Method according to claim 9, wherein, in the step of transferring the hairstyling composition to the hair, the spikes are tapped on the hair.

11. Applicator according to claim 1, wherein a total number of spikes is between 50 to 10,000.

12. Applicator according to claim 1, wherein a total number of spikes is between 1000 to 2000.

13. Method for applying a hairstyling composition comprising at least one fixing agent to hair with the aid of an applicator according to claim 1, comprising:

a step of loading the spikes of the applicator with a hairstyling composition; and a step of transferring the hairstyling composition retained on the spikes of the applicator to the hair, wherein the spikes are oriented together in the same direction such that said direction of extension of the cross section of all the spikes forms a non-zero angle with a direction of extension of the hair when the measurement sensor transmits data corresponding to a dipping of the applicator towards the hair, and wherein the spikes are applied several times to the area of the hair to be treated by using a back-and-forth movement without the applicator being rubbed along the hair.

* * * * *